US006695933B2

(12) United States Patent
Hasegawa et al.

(10) Patent No.: US 6,695,933 B2
(45) Date of Patent: Feb. 24, 2004

(54) ULTRA-HIGH STRENGTH COLD ROLLED STEEL SHEET AND METHOD FOR MANUFACTURING THE SAME

(75) Inventors: Kohei Hasegawa, Fukuyama (JP); Toshiaki Urabe, Fukuyama (JP); Akihide Yoshitake, Fukuyama (JP); Hideyuki Tsurumaru, Fukuyama (JP)

(73) Assignee: NKK Corporation, Tokyo (JP)

( * ) Notice: Subject to any disclaimer, the term of this patent is extended or adjusted under 35 U.S.C. 154(b) by 16 days.

(21) Appl. No.: 10/108,749

(22) Filed: Mar. 28, 2002

(65) Prior Publication Data

US 2003/0005986 A1 Jan. 9, 2003

Related U.S. Application Data

(63) Continuation of application No. PCT/JP01/07822, filed on Sep. 10, 2001.

(30) Foreign Application Priority Data

Sep. 12, 2000 (JP) ..... 2000-276891

(51) Int. Cl.[7] ..... C21D 8/02; C22C 38/22; C22C 38/18; C22C 38/04

(52) U.S. Cl. ..... 148/320; 148/330; 148/333; 148/334; 148/652

(58) Field of Search ..... 148/320, 330, 148/333, 334, 652

(56) References Cited

U.S. PATENT DOCUMENTS 6,224,689 B1 * 5/2001 Koo et al. ..... 148/320

FOREIGN PATENT DOCUMENTS

| | | | | |
|---|---|---|---|---|
| JP | 357013145 A | * | 1/1982 | ..... 148/330 |
| JP | 2-1894 B | | 1/1990 | |
| JP | 5-10418 B | | 2/1993 | |
| JP | 8-26401 B | | 3/1996 | |
| JP | 2528387 B | | 6/1996 | |
| JP | 10-130782 A | | 5/1998 | |
| JP | 2826058 B | | 9/1998 | |

OTHER PUBLICATIONS

JFST 1001–1996 Method of hole expanding test, *The Japan Iron and Steel Federation Standard*, (English translation), 4 pages plus 2 title pages and last page (1996).

* cited by examiner

*Primary Examiner*—Deborah Yee
(74) *Attorney, Agent, or Firm*—Frishauf, Holtz, Goodman & Chick, P.C.

(57) ABSTRACT

An ultra-high strength cold rolled steel sheet having a tensile strength of 880 to 1170 MPa, that consists essentially of 0.01 to 0.07% C, 0.3% or less Si, 0.1% or less P, 0.01% or less S, 0.01 to 0.1% sol.Al, 0.0050% or less N, 1.6 to 2.5% of the sum of at least one element selected from the group consisting of Mn, Cr, and Mo, by mass, and a balance of Fe, and that has an inner zone deeper than 10 $\mu$m from the surface of the steel sheet being substantially a martensitic single phase structure. Since the steel sheet has a hole expansion ratio of 75% or more, specified by the Standard of Japan Iron and Steel Federation, JFST1001-1996, the steel sheet has a tensile strength in a range of from 880 to 1170 MPa, and an excellent mechanically joining property, and is suitable for fabricating automobile seat frames.

27 Claims, 3 Drawing Sheets

ULTRA-HIGH STRENGTH COLD ROLLED STEEL SHEET AND METHOD FOR MANUFACTURING THE SAME

This application is a continuation application of International Application PCT/JP01/07822 (not published in English) filed Sep. 10, 2001.

BACKGROUND OF THE INVENTION

1. Field of the Invention

The present invention relates to an ultra-high strength cold rolled steel sheet, specifically to an ultra-high strength cold rolled steel sheet having 75% or higher of hole expansion ratio after blanking, specified by the Standard of Japan Iron and Steel Federation, JFST1001-1996, and having 880 to 1170 MPa of tensile strength, and to a method for manufacturing the same.

2.Description of Related Arts

Responding to the need of reduction in weight of automobiles in recent years, ultra-high strength cold rolled steel sheets having 880 to 1170 MPa of tensile strength are applied to automobile seat frames. Since the automobile seat frames are prepared by press-forming, the ultra-high strength cold rolled steel sheets are requested to have excellent stretch-flangeability, specified by JFST1001-1996, having 75% or higher of hole expansion ratio after blanking.

On the other hand, bumpers and reinforcements for doors conventionally adopt ultra-high strength cold rolled steel sheets having 880 MPa or higher of tensile strength. Aiming at further improvement in their formability and weldability, various studies have been conducted. For example, JP-B-2-1894, (the term "JP-B" referred herein signifies the "examined Japanese patent publication"), discloses a method for manufacturing an ultra-high strength cold rolled steel sheet having around 1000 MPa of tensile strength, which contains 0.10 to 0.20% C, thus providing excellent cold formability and weldability. JP-B-8-26401 and Japanese Patent No. 2528387 disclose an ultra-high strength cold rolled steel sheet that has 1470 MPa or higher of tensile strength, and excellent formability and impact characteristics by establishing fine martensitic single phase structure or by controlling the volumetric fraction of the martensite in a range of from 80 to 97%. Furthermore, Japanese Patent No.2826058 discloses an ultra-high strength cold rolled steel sheet having 1000 MPa or higher of tensile strength, inducing no hydrogen embrittlement by controlling the martensitic structure and the Fe-C based precipitates.

Those types of conventional ultra-high strength cold rolled steel sheets are, however, often subjected to successive roll-forming because they are used as bumpers and reinforcements of doors, as described above. Accordingly, they were not requested to have excellent stretch-flangeability after blanking. As a result, all of these types of steel sheets have around 50% of hole expansion ratio specified by JFST1001-1996, at the maximum, which level of hole expansion ratio is not applicable to the skeleton members for automobile seat, manufactured by press-forming.

JP-B-5-10418 discloses a high tensile strength steel sheet for laser machining, which has excellent stretch-flangeability. The steel sheet, however, has a low tensile strength of 800 MPa, and the steel sheet is not applicable to the currently used automobile seat frames.

SUMMARY OF THE INVENTION

An object of the present invention is to provide an ultra-high strength cold rolled steel sheet having 75% or higher of hole expansion ratio after blanking, specified by JFST1001-1996, and having 880 to 1170 MPa of tensile strength, and to provide a method for manufacturing the same.

The object of the present invention is attained by an ultra-high strength cold rolled steel sheet having 880 to 1170 MPa of tensile strength, which consists essentially of 0.01 to 0.07% C, 0.3% or less Si, 0.1% or less P, 0.01% or less S, 0.01 to 0.1% sol.Al, 0.0050% or less N, and 1.6 to 2.5% of sum of at least one element selected from the group consisting of Mn, Cr, and Mo, and/or 0.0005 to 0.0050% B, by mass, and balance of Fe, and has an inner zone deeper than 10 $\mu$m from the surface of the steel sheet being substantially martensitic single phase structure.

That type of ultra-high strength cold rolled steel sheet is manufactured by a method comprising the steps of: producing a steel slab having above-described composition; hot rolling the steel slab into a steel sheet, followed by cold rolling; and heating the steel sheet by continuous annealing method to temperatures of from 800 to 890° C., applying primary cooling to the annealed steel sheet at a cooling rate of 20° C./sec or less, and applying secondary cooling to the primarily cooled steel sheet at temperatures of from 680 to 750° C. to temperatures of 50° C. or below at a cooling rate of above 500° C./sec.

DETAILED DESCRIPTION OF THE INVENTION

The inventors of the present invention investigated an ultra-high strength cold rolled steel sheet that has 75% or higher of hole expansion ratio after blanking, specified by JFST1001-1996, and has 880 to 1170 MPa of tensile strength, and found that it is satisfactory to optimize the composition and to establish a fine martensitic single phase structure. The following is the detail description of the finding.

Figure 1:
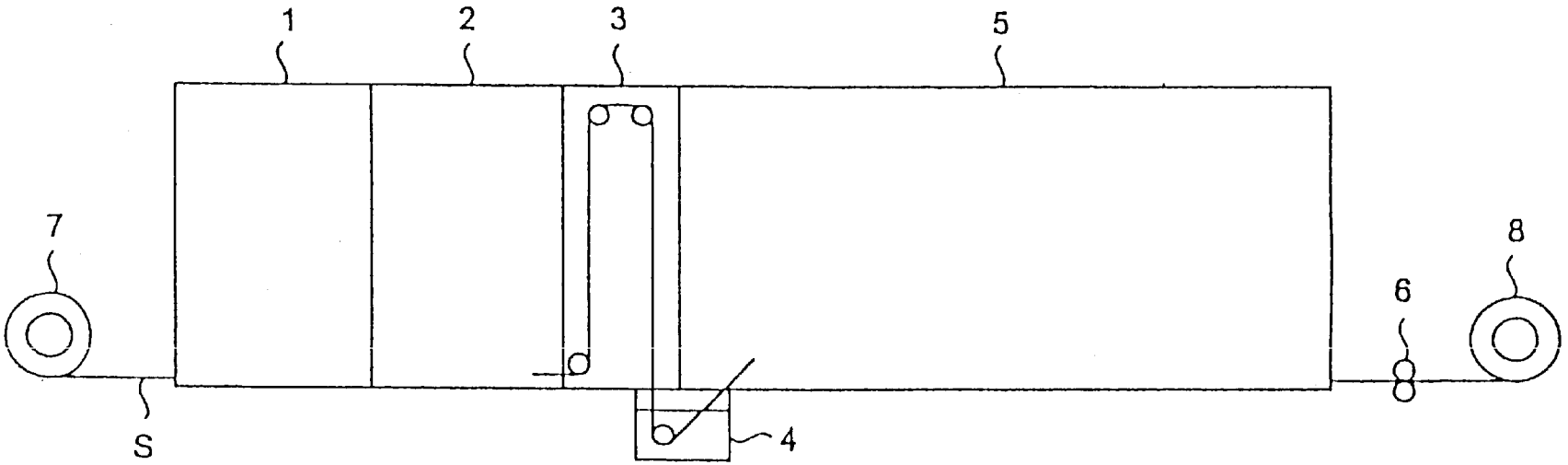
FIG. 1 shows a schematic drawing of an example of existing continuous annealing furnace.

As shown in FIG. 1, an existing continuous annealing furnace is provided with a heating zone 1 to heat a steel sheet S, a soaking zone 2 to soak thus heated steel sheet S, a slow cooling zone 3 to conduct primary cooling (slow cooling) on the soaked steel sheet S, a rapid cooling zone 4 to conduct secondary cooling (rapid cooling) on the primarily cooled steel sheet S, and a tempering zone 5 to temper the secondarily cooled steel sheet S. The steel sheet S enters the continuous annealing furnace from an inlet side rewinding unit 7, and passes through the heating zone 1, the soaking zone 2, the slow cooling zone 3, the rapid cooling zone 4, and the tempering zone 5. Then, at the exit side, the steel sheet S is skin-pass rolled by a skin-pass rolling mill 6, and finally is coiled by a coiler 8. In this course, the slow cooling zone 3 exists between the soaking zone 2 and the rapid cooling zone 4, so the temperature of the steel sheet S is unavoidably decreased by 100° C. or more.

To establish a martensitic single phase structure using such a type of existing continuous annealing furnace, it is necessary for the steel sheet S to have an austenitic single phase structure in the soaking zone 2, and to pass through the slow cooling zone 3 at temperatures of Ar3 transformation point or above, then to be rapidly cooled. With, however, conventional steels of low C equivalent having 880 to 1170 MPa of tensile strength, the Ar3 transformation point is high, so it is difficult for the steel sheet S to pass through the slow cooling zone 3 at temperatures of Ar3 transformation point or above. As a result, the formation of ferrite in the slow cooling zone 3 cannot be prevented, and no martensitic single phase structure is attained.

The inventors of the present invention conducted a study for manufacturing an ultra-high strength cold rolled steel sheet having 880 to 1170 MPa of tensile strength and having martensitic single phase structure using an existing continuous annealing furnace. The study revealed that the existing annealing furnace can provide fine martensitic single phase structure by using a steel that consists essentially of 0.01 to 0.07% C, 0.3% or less Si, 0.1% or less P, 0.01% or less S, 0.01 to 0.1% sol.Al, 0.0050% or less N, 1.6 to 2.5% of sum of at least one element selected from the group consisting of Mn, Cr, and Mo, by mass, and balance of Fe.

The following is the description about the reasons to specify individual elements.

C: Carbon content is adjusted responding to the quantity of Mn, Cr, and Mo, which are described later, to attain 880 to 1170 MPa of tensile strength. If, however, the C content is less than 0.01%, the steel making cost increases. If the C content exceeds 0.07%, the tensile strength exceeds 1170 MPa independent of the amount of Mn and other elements. Therefore, the C content is specified to a range of from 0.01 to 0.07%, preferably from 0.03 to 0.07%.

Si: Silicon is an element to raise the Ar3 transformation point, so the Si content is preferably regulated as low as possible. If the Si content exceeds 0.3%, the martensitic single phase structure having 880 to 1170 MPa of tensile strength cannot be formed. Accordingly, the Si content is specified to 0.3% or less.

P: Phosphorus can be added for adjusting the strength. If, however, the P content exceeds 0.1%, the toughness at spot welded portion is degraded. Consequently, the P content is specified to 0.1% or less.

S: Sulfur content above 0.01% induces many MnS precipitates, which degrades the stretch-flangeability. Thus, the S content is specified to 0.01% or less.

sol.Al: Aluminum is added as a deoxidizing agent. If the sol.Al content is less than 0.01%, the effect is not sufficient. If the sol.Al content exceeds 0.1%, the effect saturates to become uneconomical. Therefore, the sol.Al content is specified to a range of from 0.01 to 0.1%.

N: If the N content exceeds 0.0050%, the strength within a coil disperses. Accordingly, the N content is specified to 0.0050% or less.

Mn, Cr, Mo: These elements are critical components in the present invention. If the sum of at least one element selected from the group consisting of these elements is less than 1.6 mass %, the Ar3 transformation point cannot be satisfactorily lowered, and no fine martensitic single phase structure is obtained. If the sum exceeds 2.5 mass %, the tensile strength exceeds 1170 MPa. Consequently, the sum of at least one element selected from the group consisting of Mn, Cr, and Mo is specified to a range of from 1.6 to 2.5 mass %.

Instead of adjusting the sum of at least one element selected from the group consisting Mn, Cr, and Mo to a range of from 1.6 to 2.5 mass %, the B content may be adjusted to a range of from 0.0005 to 0.0050 mass % to attain the same effect. If the B content is less than 0.0005 mass %, the Ar3 transformation point cannot be sufficiently lowered, and fine martensitic single phase structure cannot be formed. If the B content exceeds 0.0050 mass %, the deformation resistance of steel in hot rolling increases to make it difficult to manufacture a steel sheet.

When the sum of at least one element selected from the group consisting of Mn, Cr, and Mo is adjusted to a range of from 1.6 to 2.5 mass %, and further the B content is regulated to a range of from 0.0005 to 0.0050 mass %, the content of Mn, Cr, and Mo can be reduced compared with the case that no B is added, thus the increase in the tensile strength caused by these elements is suppressed. As a result, the allowable range of C content is widened to suppress an increase in steel making cost.

If B is added, the effect of B is further increased by combining addition of Ti at a level of from $\{(48/14)\times[N]\}$ to $\{3\times(48/14)\times[N]\}$ mass %, ([N] designates the content of N). The above-described effect of B is attained when B is in solid solution state, and, if the B is bound with N to form BN, the effect decreases. Therefore, if Ti is added in advance to let N precipitate as TiN, B stays in solid solution state, and the effect of B further increases. To do this, Ti should be added by $\{(48/14)\times[N]\}$ mass % or more. If Ti is added by more than $\{3\times(48/14)\times[N]\}$ mass %, the Ti forms TiC to degrade the ductility.

When Nb is added by 0.001 to 0.04 mass % to a steel sheet containing at least one element selected from the group consisting of Mn, Cr, and Mo, and B, or further Ti, the coarsening of austenitic structure during soaking in continuous annealing can be suppressed, thus preventing the degradation of bending performance and toughness of the steel sheet.

The above-described compositions of ultra-high strength cold rolled steel sheet according to the present invention provide fine martensitic single phase structure. If an inner zone deeper than 10 $\mu$m from the surface of the steel sheet is substantially martensitic single phase structure, excellent stretch-flangeability giving 75% or higher of hole expansion ratio, specified by JFST1001-1996, is attained. The term "substantially martensitic single phase structure" referred herein signifies a martensitic structure that does not contain 1% or more of the total of ferritic structure, bainitic structure, residual austenitic structure, or the like, quantified by light microscope, scanning electron microscope, X-ray diffractometry, or the like. Nevertheless, precipitates such as AlN, MnS, and TiN, and fine iron carbide precipitated during tempering martensite may be included in the steel. Decarbonization may generate ferritic structure in the surface layer within a depth of 10 $\mu$m from the surface of the steel sheet. The ferritic structure gives very little influence on the stretch-flangeability, and rather improves the bending property. Therefore, if the inner zone deeper than 10 $\mu$m from the surface of the steel sheet is substantially martensitic single phase structure, both 880 to 1170 MPa of tensile strength and 75% or higher of hole expansion ratio can be assured.

The ultra-high strength cold rolled steel sheet according to the present invention can be manufactured by a method comprising the steps of: producing a steel slab having above-described composition; hot rolling the steel slab into a steel sheet, followed by cold rolling; and heating the steel sheet by continuous annealing method to temperatures of from 800 to 890° C., applying primary cooling to the annealed steel sheet at a cooling rate of 20° C./sec or less, and applying secondary cooling to the primarily cooled steel sheet at temperatures of from 680 to 750° C. to temperatures of 50° C. or below at a cooling rate of above 500° C./sec.

The steel slab may be produced by continuous casting process or the like.

Preferably, the steel slab is, directly or after reheated, hot rolled in a temperature range of Ar3 transformation point or above, then cooled to 700° C. or below at a cooling rate of 30° C./sec or higher, and finally coiled at 620° C. or below.

The hot rolled steel sheet is descaled and cold rolled to a target sheet thickness, followed by continuous annealing.

If the heating temperature of continuous annealing is below 800° C., it becomes difficult to keep the rapid cooling start temperature to Ar3 transformation point or above, thus failing in attaining martensitic single phase structure. If the heating temperature exceeds 890° C., the austenitic structure becomes coarse, which degrades the bending property and the toughness of the steel sheet. Therefore, the heating temperature is specified to a range of from 800 to 890° C.

The heated steel sheet is required to pass through the slow cooling zone at Ar3 transformation point or above to form the martensitic single phase structure. To do this, the primary cooling rate in the slow cooling zone is required to be 20° C./sec or less. If the primary cooling rate exceeds 20° C./sec, the temperature of steel sheet becomes lower than the Ar3 transformation point, which induces the formation of ferritic structure, and thus no martensitic single phase structure is formed.

The steel sheet after slow cooling is rapidly cooled to 50° C. or below at a secondary cooling rate of above 500° C./sec to obtain martensitic single phase structure. At that moment, if the secondary cooling start temperature is below 680° C., the ferritic structure is formed, and no martensitic single phase structure is formed. If the secondary cooling start temperature exceeds 750° C., the steel sheet shape degrades. Consequently, the secondary cooling start temperature should be specified to a range of from 680 to 750° C., preferably from 700 to 750° C. Although the method for cooling is not specifically limited, it is preferable to quench the steel sheet in water jet stream for suppressing fluctuation of material properties in width and in length directions of the steel sheet.

The steel sheet after secondary cooling down to 50° C. or below is preferably subjected to tempering in a temperature range of from 100 to 250° C. for 3 minutes or more to improve the toughness. If the tempering is done at or below 100° C. or shorter than 3 minutes, the effect of tempering is small. If the tempering is done at above 250° C., the low temperature tempering embrittlement significantly degrades the ductility.

The steel sheet after continuous annealing can be treated by skin-pass rolling. In this case, the skin-pass rolling reduction is preferably 0.3% or more in view of leveling, and 1.0% or less in view of prevention of degradation in elongation.

The ultra-high strength cold rolled steel sheet manufactured by the above-described method may be subjected to metallic coating such as Zn coating and/or surface treatment by various kinds of organic lubrication film.

EXAMPLE 1

Steel slabs having the chemical compositions given in Table 1 were produced by continuous casting method, reheated to 1250° C., hot rolled at a finishing temperature of about 870° C. to a thickness of 3.0 mm, and then coiled at temperatures of from 560 to 600° C. The hot rolled steel sheets were pickled, cold rolled to a thickness of 1.2 mm, heated to 850° C., primarily cooled in the slow cooling zone at a cooling rate of 7° C./sec, and quenched in water jet stream from 720° C. to about 40° C. to conduct secondary cooling in a continuous annealing furnace. The cooling rate of the secondary cooling was 1000° C./sec or more. The steel sheets after continuous annealing were tempered at 200° C. for about 10 minutes, and skin-pass rolled at a reduction rate of 0.5%. A section of the steel sheets parallel to the rolling direction was polished and then etched by niter. The section was observed under a scanning electron microscope to determine the volumetric fraction of martensite at an inner zone deeper than 10 $\mu$m from the surface of the steel sheets. JIS No. 5 test pieces were sampled in the direction perpendicular to the rolling direction of the steel sheets for tensile test. The hole expansion ratio was determined in accordance with JFST1001-1996. Furthermore, rectangular test pieces having a size of 30×100 mm were sampled in the rolling direction, and tested by 180° bending using a punch having a tip R of 0.5 mm pitch to determine the minimum radius of curvature that did not induce crack.

The result is given in Table 2.

The steel sheets of Steel Nos. 1 through 6, which are the Examples according to the present invention, give 880 to 1170 MPa of tensile strength, and 75% or higher of hole expansion ratio, showing excellent stretch-flangeability. The minimum bending radius is also favorable, giving 1.0 mm or less.

On the other hand, in the steel sheet of Steel No. 7 which is a comparative example containing below 1.6% of the sum of Mn, Mo, and Cr, the martensitic single phase structure can not be formed, thus, the hole expansion ratio is low, and the stretch-flangeability is degraded. In the steel sheet of Steel No. 8 containing above 0.07% of C, the strength was too high, the hole expansion ratio is low, the minimum bending radius is large, degrading the stretch-flangeability and the bending property. In the steel sheet of Steel No. 9 containing above 0.07% of C, and above 0.3% of S, the martensitic single phase structure can not be formed, the hole expansion ratio is low, and the stretch-flangeability is degraded. In the steel sheet of Steel No. 10 exceeding 2.5% of the sum of Mn, Mo, and Cr, the tensile strength is too high, the hole expansion ratio is low, and the minimum bending radius is large, degrading the stretch-flangeability and the bending property.

TABLE 1

| Steel No. | C | Si | Mn | P | S | sol. Al | N | Cr | Mo | Nb | Ti | B | Mn + Cr + Mo | (48/14)*N | 3*(48/14)*N | Remark |
|---|---|---|---|---|---|---|---|---|---|---|---|---|---|---|---|---|
| 1 | 0.030 | 0.03 | 2.20 | 0.010 | 0.002 | 0.030 | 0.0030 | 0.04 | tr | tr | tr | tr | 2.24 | 0.010 | 0.031 | Example steel |
| 2 | 0.040 | 0.01 | 2.05 | 0.010 | 0.002 | 0.030 | 0.0028 | 0.04 | tr | tr | tr | 0.0012 | 2.09 | 0.010 | 0.029 | Example steel |

TABLE 1-continued

| Steel No. | C | Si | Mn | P | S | sol. Al | N | Cr | Mo | Nb | Ti | B | Mn + Cr + Mo | (48/14)*N | 3*(48/14)*N | Remark |
|---|---|---|---|---|---|---|---|---|---|---|---|---|---|---|---|---|
| 3 | 0.050 | 0.02 | 1.90 | 0.010 | 0.002 | 0.030 | 0.0024 | 0.04 | tr | tr | 0.022 | 0.0013 | 1.94 | 0.008 | 0.025 | Example steel |
| 4 | 0.065 | 0.03 | 1.65 | 0.010 | 0.002 | 0.030 | 0.0035 | 0.50 | tr | tr | 0.015 | 0.0011 | 2.15 | 0.012 | 0.036 | Example steel |
| 5 | 0.050 | 0.02 | 1.30 | 0.010 | 0.002 | 0.030 | 0.0031 | 0.30 | 0.20 | tr | 0.021 | 0.0009 | 1.80 | 0.011 | 0.032 | Example steel |
| 6 | 0.050 | 0.02 | 1.90 | 0.010 | 0.002 | 0.030 | 0.0027 | 0.30 | tr | 0.015 | 0.019 | 0.0012 | 2.20 | 0.009 | 0.028 | Example steel |
| 7 | 0.080 | 0.01 | 1.50 | 0.010 | 0.002 | 0.031 | 0.004 | 0.03 | tr | tr | tr | tr | 1.53 | 0.012 | 0.036 | Comparative steel |
| 8 | 0.155 | 0.05 | 1.95 | 0.010 | 0.002 | 0.031 | 0.004 | 0.03 | tr | tr | tr | tr | 1.98 | 0.012 | 0.036 | Comparative steel |
| 9 | 0.165 | 1.40 | 1.89 | 0.010 | 0.002 | 0.031 | 0.004 | 0.03 | tr | tr | tr | tr | 1.92 | 0.012 | 0.036 | Comparative steel |
| 10 | 0.060 | 0.01 | 2.45 | 0.010 | 0.002 | 0.031 | 0.004 | 0.58 | tr | tr | tr | tr | 3.01 | 0.012 | 0.036 | Comparative steel |

Unit: mass %

TABLE 2

| Steel No. | Volumetric fraction of martensite (%) | Yield strength YP (MPa) | Tensile strength TS (MPa) | Elongation El (%) | Hole expansion ratio (%) | Minimum bending radius (mm) | Remark |
|---|---|---|---|---|---|---|---|
| 1 | 100 | 892 | 1029 | 7.3 | 105 | 1.0 | Inventive example |
| 2 | 100 | 872 | 1000 | 7.5 | 110 | 1.0 | Inventive example |
| 3 | 100 | 882 | 990 | 7.9 | 115 | 1.0 | Inventive example |
| 4 | 100 | 862 | 980 | 8.3 | 120 | 1.0 | Inventive example |
| 5 | 100 | 882 | 1039 | 7.2 | 102 | 1.0 | Inventive example |
| 6 | 100 | 911 | 1058 | 7.0 | 100 | 0.5 | Inventive example |
| 7 | 70 | 686 | 882 | 15.0 | 35 | 0.5 | Comparative example |
| 8 | 100 | 1176 | 1470 | 6.0 | 60 | 4.0 | Comparative example |
| 9 | 50 | 882 | 1274 | 8.0 | 32 | 3.5 | Comparative example |
| 10 | 100 | 1078 | 1372 | 7.0 | 30 | 3.0 | Comparative example |

EXAMPLE 2

With the steel slabs having the same compositions with those of Steel Nos. 1 through 3 in Example 1, the steps until the cold rolling were given under the same conditions with those of Example 1, then the annealing and the skin-pass rolling were given under the conditions shown in Table 3, thus manufactured the steel sheets A through H. With the similar procedure as in Example 1, the volumetric fraction of the martensite, the tensile strength, and the hole expansion ratio were determined. Furthermore, the applicability to the mechanical joining which can be done without heating was evaluated by the peeling strength which was determined by the method described below.

Figure 2A:
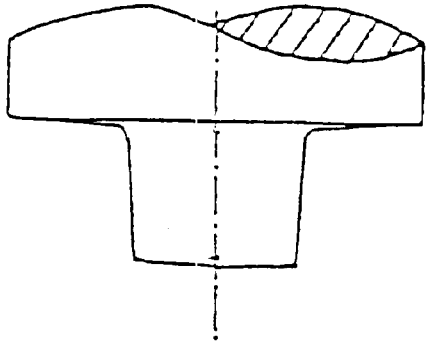
FIGS. 2A through 2C show schematic drawings of an example of mechanical joining method.
Figure 2B:
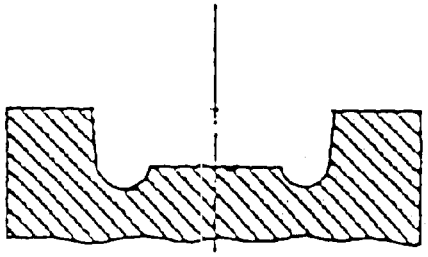
Figure 2C:
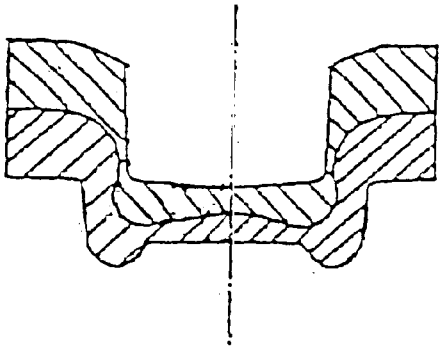
Figure 3:
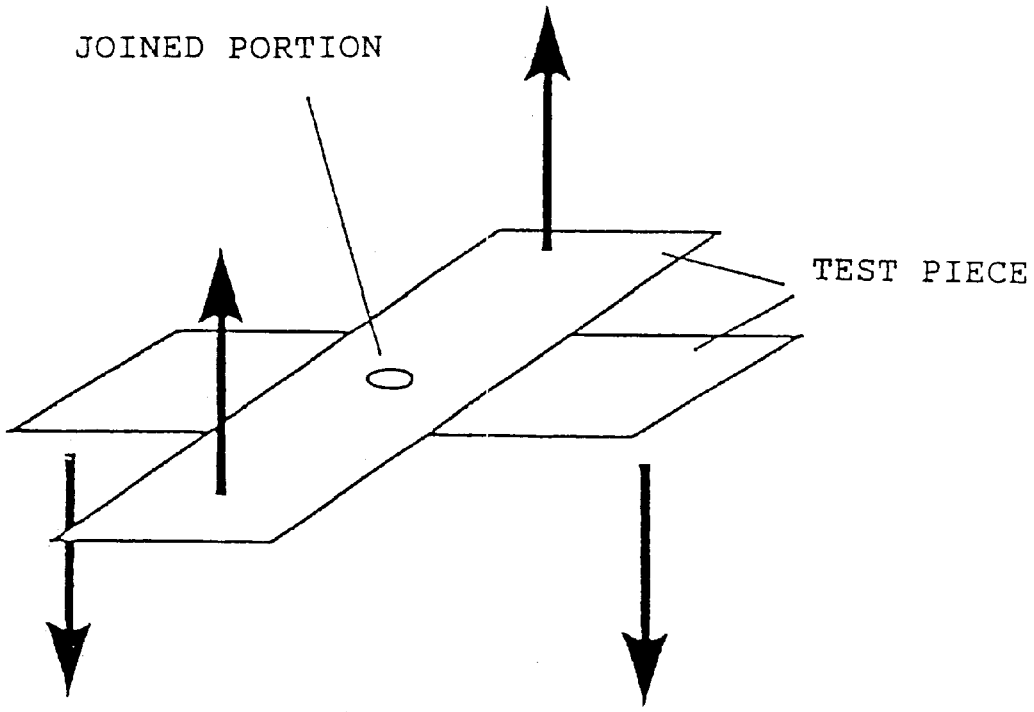
FIG. 3 shows a schematic drawing of peeling test method after mechanical joining.

Determination of peeling strength at a mechanically joined portion:

Two test pieces in rectangular shape are overlaid to each other in a form that the longitudinal direction thereeach crosses in right angle at center of each of them. They are press-formed at center of thereeach using a punch (5.6 mm in punch diameter) in cylindrical shape, shown in FIG. 2A, and using a die (8 mm in die diameter and 1.2 mm in die depth) having a ring-shape groove at periphery of the bottom section, as shown in FIG. 2B, respectively. At that moment, the two test pieces are mechanically joined together as shown in FIG. 2C because the plastic flow occurs to flow into the groove at bottom of the die, (Von Hanns Peter Liebig et al., VDI-Z, 131 (1989) 95). After that, as illustrated in FIG. 3, edges of each test piece are pulled vertically to the face thereof in opposite direction to each of test pieces, and the strength on peeling the joined portion is determined. The relation between the peeling strength and the mechanical joining performance was investigated in advance, and it was found the sufficient mechanical joining was assured if the peeling strength was at or higher than 2.0 kN.

The result is shown in Table 3.

The steel sheets Nos. A through D, which are the example of the present invention, provide 100% of volumetric fraction of the martensite, about 1000 MPa of tensile strength, 100% or higher of hole expansion ratio, showing excellent stretch-flangeability. Furthermore, they show 2.0 kN or higher of peeling strength, thus attaining excellent mechanical joining property.

On the other hand, the steel sheet E which is a comparative example annealed below 800° C. of heating temperature, the steel sheet F subjected to primary cooling at a cooling rate of above 20° C./sec after heating, the steel sheet G subjected to secondary cooling at a cooling rate of below 500° C./sec, and the steel sheet H with a finish temperature above 50° C. in the secondary cooling at a cooling rate of above 500° C./sec, they can not provide martensitic single phase structure, less than 880 MPa of tensile strength, less than 75% of hole expansion ratio, and less than 2.0 kN of peeling strength.

TABLE 3

| Steel sheet | Steel No | Heating Temperature (° C.) | Primary cooling rate (° C./s) | Secondary cooling start temperature (° C.) | Secondary cooling rate (° C./s) | Secondary cooling finish temperature (° C.) | Tempering temperature (° C.) | Skin-pass rolling (%) | Volumetric fraction of martensite (%) | YP (MPa) | TS (MPa) | El (%) | Hole expansion ratio (%) | Peeling strength (kN) | Remark |
|---|---|---|---|---|---|---|---|---|---|---|---|---|---|---|---|
| A | 1 | 860 | 5 | 720 | 2000 | 20 | 200 | 0.5 | 100 | 860 | 1040 | 7.5 | 110 | 2.2 | Example |
| B | 2 | 870 | 10 | 740 | 2000 | 50 | 150 | 0.3 | 100 | 870 | 1020 | 8.0 | 115 | 2.1 | Example |
| C | 3 | 860 | 8 | 730 | 2000 | 40 | 220 | 0.4 | 100 | 850 | 1000 | 7.8 | 110 | 2.0 | Example |
| D | 1 | 840 | 7 | 720 | 2000 | 45 | 180 | 0.5 | 100 | 900 | 1050 | 7.3 | 105 | 2.3 | Example |
| E | 2 | 780 | 4 | 670 | 2000 | 40 | 200 | 0.5 | 80 | 780 | 860 | 15.0 | 45 | 0.9 | Comparative Example |
| F | 1 | 850 | 25 | 660 | 2000 | 40 | 200 | 0.5 | 70 | 740 | 840 | 16.0 | 40 | 0.8 | Comparative Example |
| G | 2 | 830 | 3 | 720 | 50 | 40 | 200 | 0.3 | 50 | 450 | 750 | 22.0 | 35 | 0.7 | Comparative Example |
| H | 3 | 840 | 10 | 700 | 2000 | 250 | 200 | 0.5 | 40 | 700 | 850 | 13.0 | 25 | 0.9 | Comparative Example |

What is claimed is:

1. An ultra-high strength cold rolled steel sheet having a tensile strength of 880 to 1170 MPa, and consisting essentially of 0.01 to 0.07% C, 0.3% or less Si, 0.1% or less P, 0.01% or less S, 0.01 to 0.1% sol.Al, 0.0050% or less N, 1.6 to 2.5% of the sum of at least one element selected from the group consisting of Mn, Cr, and Mo, by mass, and a balance of Fe, and having an inner zone deeper than 10 $\mu$m from a surface of the steel sheet being substantially a martensitic single phase structure.

2. An ultra-high strength cold rolled steel sheet having a tensile strength of 880 to 1170 MPa, and consisting essentially of 0.01 to 0.07% C, 0.3% or less Si, 0.1% or less P, 0.01% or less S, 0.01 to 0.1% sol.Al, 0.0050% or less N, 0.0005 to 0.0050% B, by mass, and a balance of Fe, and having an inner zone deeper than 10 $\mu$m from a surface of the steel sheet being substantially a martensitic single phase structure.

3. An ultra-high strength cold rolled steel sheet having a tensile strength of 880 to 1170 MPa, and consisting essentially of 0.01 to 0.07% C, 0.3% or less Si, 0.1% or less P, 0.01% or less S, 0.01 to 0.1% sol.Al, 0.0050% or less N, 1.6 to 2.5% of the sum of at least one element selected from the group consisting of Mn, Cr, and Mo, 0.0005 to 0.0050% B, by mass, and a balance of Fe, and having an inner zone deeper than 10 $\mu$m from a surface of the steel sheet being substantially a martensitic single phase structure.

4. An ultra-high strength cold rolled steel sheet having a tensile strength of 880 to 1170 MPa, and consisting essentially of 0.01 to 0.07% C, 0.3% or less Si, 0.1% or less P, 0.01% or less 5, 0.01 to 0.1% sol.Al, 0.0050% or less N, 1.6 to 2.5% of the sum of at least one element selected from the group consisting of Mn, Cr, and Mo, 0.0005 to 0.0050 B, $\{(48/14)\times[N])$ to $\{3\times(48/14)\times[N]\}$% Ti, by mass, and a balance of Fe, and having an inner zone deeper than 10 $\mu$m from a surface of the steel sheet being substantially a martensitic single phase structure.

5. An ultra-high strength cold rolled steel sheet having a tensile strength of 880 to 1170 MPa, and consisting essentially of 0.01 to 0.07% C, 0.3% or less Si, 0.1% or less P, 0.01% or less S, 0.01 to 0.1% sol.Al, 0.0050% or less N, 1.6 to 2.5% of the sum of at least one element selected from the group consisting of Mn, Cr, and Mo, 0.001 to 0.04% Nb, by mass, and a balance of Fe, and having an inner zone deeper than 10 μm from a surface of the steel sheet being substantially a martensitic single phase structure.

6. An ultra-high strength cold rolled steel sheet having a tensile strength of 880 to 1170 MPa, and consisting essentially of 0.01 to 0.07% C, 0.3% or less Si, 0.1% or less P0.01% or less S, 0.01 to 0.1% sol.Al, 0.0050% or less N, 1.6 to 2.5% of the sum of at least one element selected from the group consisting of Mn, Cr, and Mo, 0.0005 to 0.0050% B, 0.001 to 0.04% Nb, by mass, and a balance of Fe, and having an inner zone deeper than 10 μm from a surface of the steel sheet being substantially martensitic single phase structure.

7. An ultra-high strength cold rolled steel sheet having a tensile strength of 880 to 1170 MPa, and consisting essentially of 0.01 to 0.07% C, 0.3% or less Si, 0.1% or less P, 0.01% or less S, 0.01 to 0.1% sol.Al, 0.0050% or less N, 1.6 to 2.5% of the sum of at least one element selected from the group consisting of Mn, Cr, and Mo, 0.0005 to 0.0050% B, {(48/14)×[N]}to {3×(48/14)×[N]}% Ti, 0.001 to 0.04% Nb, by mass, and a balance of Fe, and having an inner zone deeper than 10 μm from a surface of the steel sheet being substantially a martensitic single phase structure.

8. A method for manufacturing an ultra-high strength cold rolled steel sheet having a tensile strength of 880 to 1170 MPa, the method comprising the steps of:

producing a steel slab having a composition according to claim 1;

hot rolling the steel slab into a steel sheet, followed by cold rolling; and heating the steel sheet by a continuous annealing method to a temperature of from 800 to 890° C., applying a primary cooling to the annealed steel sheet at a cooling rate of 20° C./sec or less to produce a primarily cooled steel sheet, and applying a secondary cooling to the primarily cooled steel sheet at a temperature of from 680 to 750° C. to a temperature of 50° C. or below at a cooling rate of above 500° C./sec.

9. A method for manufacturing an ultra-high strength cold rolled steel sheet having a tensile strength of 880 to 1170 MPa, the method comprising the steps of:

producing a steel slab having a composition according to claim 2;

hot rolling the steel slab into a steel sheet, followed by cold rolling; and heating the steel sheet by a continuous annealing method to a temperature of from 800 to 890° C., applying a primary cooling to the annealed steel sheet at a cooling rate of 20° C./sec or less to produce a primarily cooled steel sheet, and applying a secondary cooling to the primarily cooled steel sheet at a temperature of from 680 to 750° C. to a temperature of 50° C. or below at a cooling rate of above 500° C./sec.

10. A method for manufacturing an ultra-high strength cold rolled steel sheet having a tensile strength of 880 to 1170 MPa, the method comprising the steps of:

producing a steel slab having a composition according to claim 3;

hot rolling the steel slab into a steel sheet, followed by cold rolling; and heating the steel sheet by a continuous annealing method to a temperature of from 800 to 890° C. to produce an annealed steel sheet, applying a primary cooling to the annealed steel sheet at a cooling rate of 20° C./sec or less to produce a primarily cooled steel sheet, and applying a secondary cooling to the primarily cooled steel sheet at a temperature of from 680 to 750° C. to a temperature of 50° C. or below at a cooling rate of above 500° C./sec.

11. A method for manufacturing an ultra-high strength cold rolled steel sheet having a tensile strength of 880 to 1170 MPa, the method comprising the steps of:

producing a steel slab having a composition according to claim 4;

hot rolling the steel slab into a steel sheet, followed by cold rolling; and heating the steel sheet by a continuous annealing method to a temperature of from 800 to 890° C. to produce an annealed steel sheet, applying a primary cooling to the annealed steel sheet at a cooling rate of 20° C./sec or less, and applying a secondary cooling to the primarily cooled steel sheet at a temperature of from 680 to 750° C. to a temperature of 50° C. or below at a cooling rate of above 500° C./sec.

12. A method for manufacturing an ultra-high strength cold rolled steel sheet having a tensile strength of 880 to 1170 MPa, the method comprising the steps of:

producing a steel slab having a composition according to claim 5;

hot rolling the steel slab into a steel sheet, followed by cold rolling; and heating the steel sheet by a continuous annealing method to a temperature of from 800 to 890° C. to produce an annealed steel sheet, applying a primary cooling to the annealed steel sheet at a cooling rate of 20° C./sec or less, and applying a secondary cooling to the primarily cooled steel sheet at a temperature of from 680 to 750° C. to a temperature of 50° C. below at a cooling rate of above 500° C./sec.

13. A method for manufacturing an ultra-high strength cold rolled steel sheet having a tensile strength of 880 to 1170 MPa, the method comprising the steps of:

producing a steel slab having a composition according to claim 6;

hot rolling the steel slab into a steel sheet, followed by cold rolling; and heating the steel sheet by a continuous annealing method to a temperature of from 800 to 890° C. to produce an annealed steel sheet, applying a primary cooling to the annealed steel sheet at a cooling rate of 20° C./sec or less to produce a primarily cooled steel sheet, and applying a secondary cooling to the primarily cooled steel sheet at a temperature of from 680 to 750° C. to a temperature of 50° C. below at a cooling rate of above 500° C./sec.

14. A method for manufacturing an ultra-high strength cold rolled steel sheet having a tensile strength of 880 to 1170 MPa, the method comprising the steps of:

producing a steel slab having a composition according to claim 7;

hot rolling the steel slab into a steel sheet, followed by cold rolling; and heating the steel sheet by a continuous annealing method to a temperature of from 800 to 890° C. to produce an annealed steel sheet, applying a primary cooling to the annealed steel sheet at a cooling rate of 20° C./sec or less to produce a primarily cooled steel sheet, and applying a secondary cooling to the primarily cooled steel sheet at a temperature of from 680 to 750° C. to a temperature of 50° C. or below at a cooling rate of above 500° C./sec.

15. An automobile seat frame made from an ultra-high strength cold rolled steel sheet according to claim 1.

16. An automobile seat frame made from an ultra-high strength cold rolled steel sheet according to claim 2.

17. An automobile seat frame made from an ultra-high strength cold rolled steel sheet according to claim 3.

18. An automobile seat frame made from an ultra-high strength cold rolled steel sheet according to claim 4.

19. An automobile seat frame made from an ultra-high strength cold rolled steel sheet according to claim 5.

20. An automobile seat frame made from an ultra-high strength cold rolled steel sheet according to claim 6.

21. An automobile seat frame made from an ultra-high strength cold rolled steel sheet according to claim 7.

22. The ultra-high strength cold rolled steel sheet according to 1, wherein the steel sheet after blanking has a 75% or higher hole expansion ratio.

23. The ultra-high strength cold rolled steel sheet according to claim 2, wherein the steel sheet after blanking has a 75% or higher hole expansion ratio.

24. The ultra-high strength cold rolled steel sheet according to claim 3, wherein the steel sheet after blanking has a 75% or higher hole expansion ratio.

25. The ultra-high strength cold rolled steel sheet according to claim 4, wherein the steel sheet after blanking has a 75% or higher hole expansion ratio.

26. The ultra-high strength cold rolled steel sheet according to claim 5, wherein the steel sheet after blanking has a 75% or higher hole expansion ratio.

27. The ultra-high strength cold rolled steel sheet according to claim 6, wherein the steel sheet after blanking has a 75% or higher hole expansion ratio.

* * * * *